US007456482B2

(12) United States Patent
Busta et al.

(10) Patent No.: US 7,456,482 B2
(45) Date of Patent: Nov. 25, 2008

(54) CARBON NANOTUBE-BASED ELECTRONIC SWITCH

(75) Inventors: Heinz H. Busta, Park Ridge, IL (US); Ian W. Wylie, Naperville, IL (US); Gary W. Snider, Oswego, IL (US)

(73) Assignee: Cabot Microelectronics Corporation, Aurora, IL (US)

( * ) Notice: Subject to any disclaimer, the term of this patent is extended or adjusted under 35 U.S.C. 154(b) by 368 days.

(21) Appl. No.: 11/084,287

(22) Filed: Mar. 18, 2005

(65) Prior Publication Data

US 2006/0273871 A1 Dec. 7, 2006

(51) Int. Cl.
*H01H 59/00* (2006.01)

(52) U.S. Cl. ..... 257/415; 200/181; 257/E29.324; 257/E51.04; 977/709; 977/731; 977/743; 977/745; 977/932

(58) Field of Classification Search ..... 365/164, 365/166; 977/708, 709, 724, 725, 731, 734, 977/742, 745, 750, 752, 932, 743, 940; 257/415, 257/E29.324, E51.04; 200/181
See application file for complete search history.

(56) References Cited

U.S. PATENT DOCUMENTS

| | | | | |
|---|---|---|---|---|
| 4,656,445 | A * | 4/1987 | Bagepalli et al. | 335/195 |
| 4,994,776 | A | 2/1991 | Juncu | |
| 5,304,971 | A | 4/1994 | Sturman et al. | |
| 5,430,597 | A | 7/1995 | Bagepalli et al. | |
| 6,005,459 | A | 12/1999 | Hoffman | |
| 6,157,043 | A | 12/2000 | Miyamoto | |
| 6,366,186 | B1 | 4/2002 | Hill et al. | |
| 6,473,351 | B2 * | 10/2002 | Tomanek et al. | 365/215 |
| 6,515,325 | B1 | 2/2003 | Farnworth et al. | |
| 6,874,668 | B2 * | 4/2005 | Cumings et al. | 225/3 |
| 7,238,425 | B2 * | 7/2007 | Cumings et al. | 428/403 |
| 7,382,648 | B2 * | 6/2008 | Bockrath | 365/164 |
| 2002/0001905 | A1 | 1/2002 | Choi et al. | |
| 2002/0070426 | A1 * | 6/2002 | Cumings et al. | 257/613 |
| 2002/0163414 | A1 | 11/2002 | Mayer et al. | |
| 2003/0098488 | A1 | 5/2003 | O'Keeffe et al. | |
| 2003/0122133 | A1 | 7/2003 | Choi et al. | |
| 2003/0122207 | A1 | 7/2003 | Yen et al. | |
| 2003/0122640 | A1 | 7/2003 | Deligianni et al. | |
| 2007/0170071 | A1 * | 7/2007 | Suh et al. | 205/687 |
| 2007/0171707 | A1 * | 7/2007 | Maslov et al. | 365/185.01 |
| 2007/0188268 | A1 * | 8/2007 | Naito et al. | 333/186 |

OTHER PUBLICATIONS

Cumings, John and Zettl, A., "Low-Friction Nanoscale Linear Bearing Realized from Multiwall Carbon Nanotubes", *Science*, 28, 602-604, Jul. 28, 2000.

* cited by examiner

*Primary Examiner*—Richard Elms
*Assistant Examiner*—Michael Lulis
(74) *Attorney, Agent, or Firm*—Thomas E. Omholt; Phillip M. Pippenger; Steven D. Weseman

(57) ABSTRACT

An improved microelectromechanical switch assembly comprises a linearly movable switch rod constrained via a switch bearing, the switch rod being actuated by electrostatic deflection. Movement of the switch rod to one end of its travel puts the switch assembly in a closed state while movement of the switch rod to the other end of its travel puts the switch assembly in an open state. In an embodiment of the invention, one or both of the switch rod and the switch bearing are fabricated of a carbon nanotube. The improved microelectromechanical switch assembly provides low insertion loss and long lifetime in an embodiment of the invention.

16 Claims, 13 Drawing Sheets

CARBON NANOTUBE-BASED ELECTRONIC SWITCH

FIELD OF THE INVENTION

This invention relates generally to electronic switching and, more particularly, relates to a nanotube-based electronic switch having small dimensions and low switching friction and switching power requirements.

BACKGROUND

The increasing miniaturization of computer digital circuitry and other components has enabled a corresponding increase in computer power and decrease in the cost of creating powerful computing devices. However, certain critical components have not progressed as rapidly with respect to miniaturization, and the effects of this lag are beginning to limit the overall miniaturization of computing devices. For example, electronic switches (as opposed to purely solid state electrical switches such as transistors) are inherently mechanical in nature, and as such rely on forming and shaping steps that are not critical with respect to purely electrical systems.

Before discussing microelectromechanical switch technology, a brief discussion of solid state switch technologies will be presented. Typically, a solid-state switch comprises a transistor element such as a FET (Field Effect Transistor), MOSFET (Metal Oxide Semiconductor Field Effect Transistor), JFET (Junction Field Effect Transistor), MESFET (Metal Semiconductor Field Effect Transistor), etc. Typically, transistor devices will operate in an essentially linear manner over only a small gate voltage region, outside of which the device is either off or saturated. The off and saturated states are useful for switching applications.

There are a number of difficulties associated with the production and use of solid-state switches such as those discussed above. Drawbacks include high insertion losses, high contact resistance, high switching capacitance, signal and gate cross-coupling, high-frequency electronic noise, reliance on semiconductor properties (with attendant requirements for heavy fabrication process control), and out diffusion difficulties. For these reasons, microelectromechanical devices may be more suitable in certain miniature switch applications.

An example of such a switch is the microelectromechanical switch described in U.S. Published Application 2003/0122640 to Deligianni et al. The device described in that application comprises a movable part, two pairs of contacts, and actuators. The movable part is laterally or pivotally deflected by the actuators to make or break connections across pairs of contacts. While the device is said to solve certain shortcomings inherent in the production and use of solid state switches and some microelectromechanical switches, many problems remain. For example, precise fabrication control with respect to pivots, brackets, etc. is required to ensure that the actuator is movable within the required bounds but that it does not stray a prohibitive amount from its intended range and path of travel. Moreover, the quality of the ohmic contact produced depends upon the precision with which the actuator moves, and hence the precision with which the various mating parts are fabricated. Moreover, the actuator experiences flexion stresses, which, while perhaps less severe than experienced in prior designs, may still cause fatigue with long-term usage.

For these reasons and others, a microelectromechanical switch is needed that eliminates the drawbacks of former solid state switches and microelectromechanical switches alike.

BRIEF SUMMARY OF THE INVENTION

Embodiments of the invention provide a new microelectromechanical switch that solves the problems inherent in prior systems. The new microelectromechanical switch comprises, in an embodiment of the invention, a switch rod having switch contacts at each end of the rod. The switch rod is free to travel linearly along its primary axis between two limit positions. A hollow bearing rod having essentially the same primary axis as that of the switch rod is sized and positioned to surround the switch rod to form a bearing and to constrain the switch rod to motion along its primary axis. First and second relay contacts associated with the respective first and second switch contacts are situated near respective ends of the switch rod and are operable to move the switch rod along its primary axis. When the switch rod is at one end of its travel, the first switch contact conductively bridges a first switch terminal to a second switch terminal. When the switch rod is in at the opposite end of its travel, the first switch contact does not conductively bridge the first switch terminal to the second switch terminal and the circuit between the first and second switch terminals is thus open.

The mechanism for moving the switch rod is not critical; however in an embodiment of the invention the relay contacts are tailored to apply an electrostatic deflection field. The deflection field in turn causes the switch rod to move between the first and second limit positions. In a further embodiment of the invention, the switch element and the hollow bearing rod each comprise a nanotube comprised substantially of carbon atoms.

In yet a further embodiment of the invention, an insulator element is situated between the second relay contact and the second switch contact, so that when the switch rod is in the second limit position (i.e. the switch assembly is in an open state), the second switch contact is in contact with the insulator element and is not in conductive contact with the second relay contact. The switch described with respect to the exemplary embodiment herein preferably, although not necessarily, comprises a frame element holding each of the relay contacts and the hollow bearing rod in a fixed spatial relation with respect one another, and may also comprise an insulator portion interposed between the hollow bearing rod and the first relay contact.

In alternative embodiments of the invention, one of the relay contacts may be omitted. In addition, in a further embodiment of the invention, one or more relay contacts are situated such that insulation is not needed to shield the contact (s). In yet another embodiment of the invention, wherein the switch rod and bearing tube each comprise a nanotube, actuation of the switch rod in one direction, such as to open the switch, is by way of an intertube interaction between the switch rod and the bearing tube.

Some of the benefits attainable by the exemplary embodiment of the switch described herein are that it has low insertion loss, high immunity to electronic switching noise, and has low switching power. Due to the extremely small size of the components, especially when carbon nanotubes are employed as one or both of the bearing and the switch rod, the switch is significantly miniaturized and is useful for many applications requiring small low-loss switches.

Additional features and advantages of the invention will be made apparent from the following detailed description of illustrative embodiments which proceeds with reference to the accompanying FIGS.

BRIEF DESCRIPTION OF THE DRAWINGS

While the appended claims set forth the features of the present invention with particularity, the invention, together with its objects and advantages, may be best understood from the following detailed description taken in conjunction with the accompanying drawings of which:

DETAILED DESCRIPTION

Figure 1:
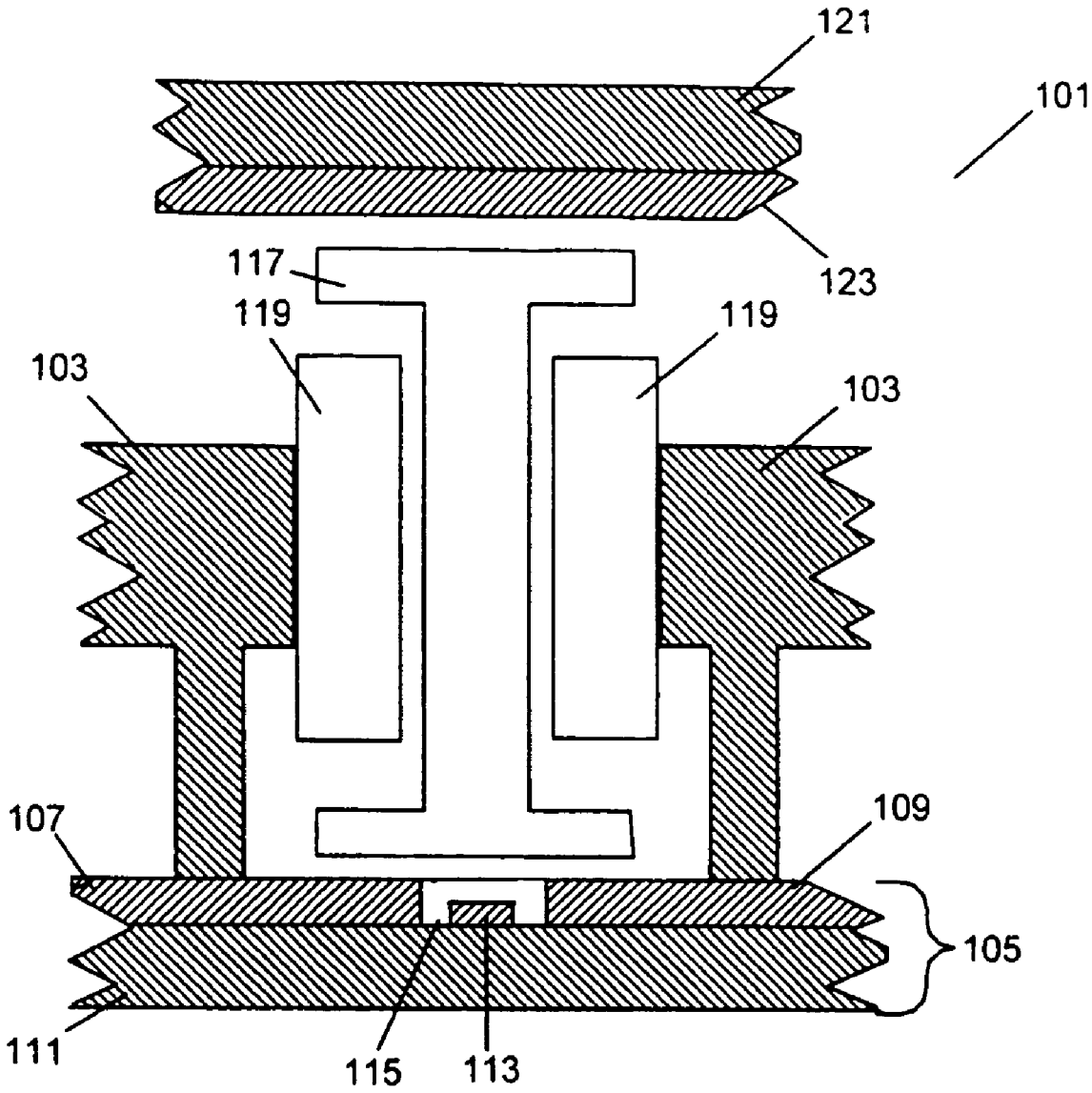
FIG. 1 is a cross-sectional side view of an exemplary microelectromechanical switch according to an embodiment of the invention.

Turning to the drawings, wherein like reference numerals refer to like elements, the structure of a switch assembly according to various embodiments of the invention will be discussed, after which the fabrication of various switch components according to embodiments of the invention will be addressed. FIG. 1 shows a cross-sectional side view of an example microelectromechanical switch assembly 101 according to an embodiment of the invention. In particular, the switch assembly 101 in this embodiment of the invention comprises a frame 103 preferably fabricated of a substantially insulating material. The frame 103 is fixed to a base 105 comprising, at least in the vicinity of the switch 101, first and second terminals labeled 107 and 109 respectively fixed to a substrate 111. While shown in cross-section, the frame 103 may be of round, square or other configuration as viewed from above or below.

The first and second terminals or switch contacts 107, 109 are preferably fabricated of a conductive material such as, for purposes of illustration and not limitation, heavily doped silicon or metal as will be appreciated by those of skill in the art. The substrate 111 is preferably electrically nonconductive, or insulating, such that it does not provide a conduction path between the first and second terminals 107, 109. Exemplary materials for use as the substrate 111 include silicon dioxide, silicon nitride, undoped crystalline silicon, amorphous silicon, or other inexpensive or convenient material. The substrate 111 may be comprised of multiple layers of diverse materials or a single layer. If the substrate 111 is comprised of multiple layers, at least the top layer typically should be nonconductive as discussed above. The contacts 107 and 109 may optionally be coated with a hard electrically conductive material such as doped diamond, tungsten, platinum, etc. for the area on the contact that will be subject to mechanical wear. This may be useful in enhancing the mechanical reliability of the device.

Figure 8:
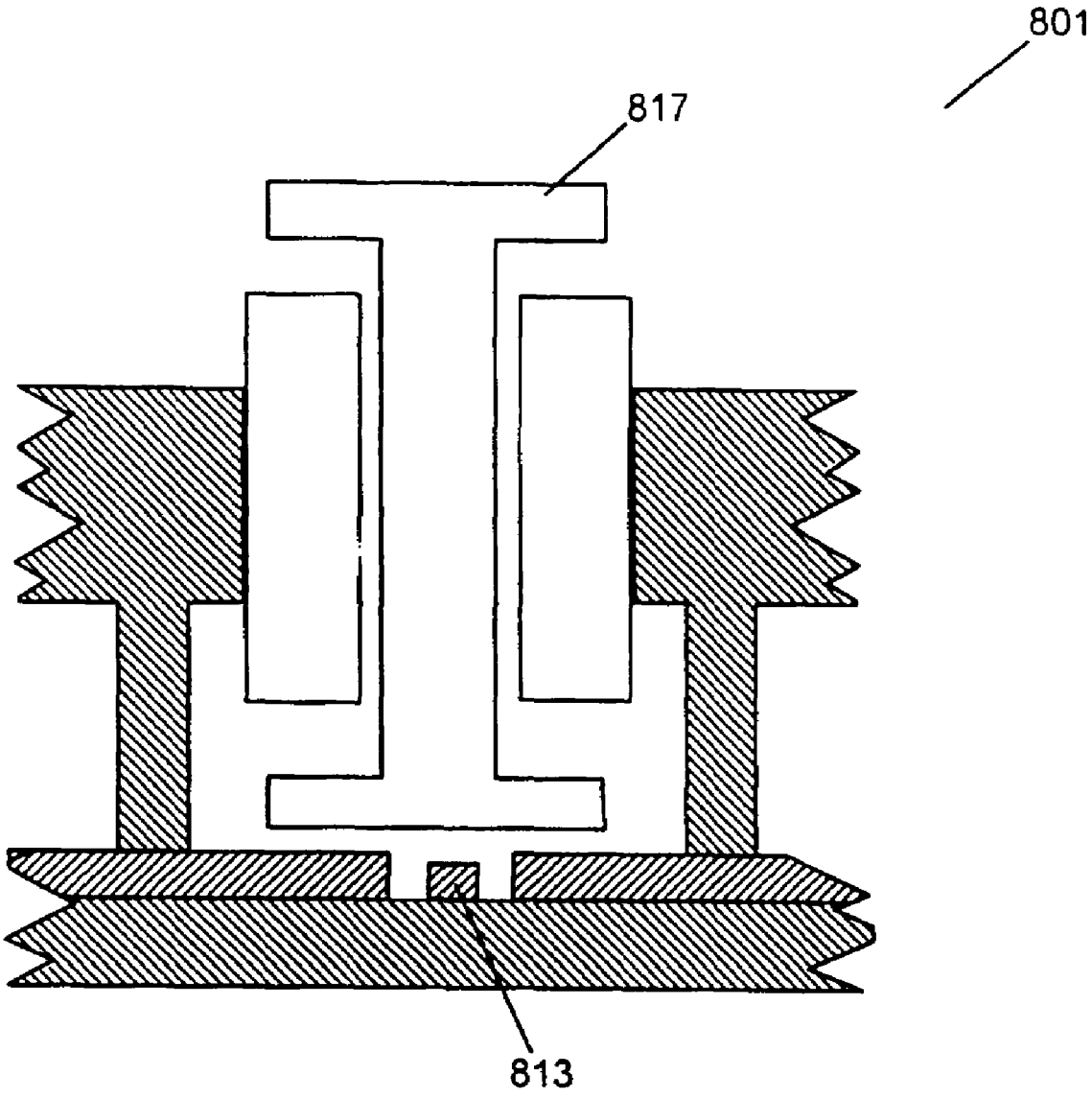
FIG. 8 is a cross-sectional side view of a microelectromechanical switch according to an embodiment of the invention having an alternative frame construction.

A pull-in contact 113 is positioned between the first and second terminals 107, 109 and is preferably fabricated of a conductive material such as, for example, heavily doped silicon, metal, etc. In order to electrically isolate the pull-in contact 113 from the other components of the switch 101, the pull-in contact 113 is encased on a first side by the substrate 111 and on its remaining sides by an insulation layer 115. Preferably, the top surface of the insulating layer 115 is level with or lower than the top surfaces of the first and second terminals 107, 109. This is so that an essentially planar or linear contact, to be discussed below, can bridge the first and second terminals 107, 109 without being blocked by the top surface of the insulating layer 115. In an embodiment of the invention, the layer 115 is omitted, and the contact 113 is situated so as to avoid contact with the switch element 117, to be discussed below. One such configuration is illustrated by the switch 801 shown in FIG. 8. Referring to this figure, it can be seen that pull-in contact 813 is unshielded but is situated to avoid contact with switch element 817 throughout the entire range of travel of the switch element 817.

In an embodiment of the invention, the switch 101 further comprises a pull-back contact 121. The pull-back contact 121 is preferably electrically conductive as with the pull-in contact 113, and may be, but is not required to be, made of the same material as the pull-in contact 113. The pull-back contact 121 is preferably electrically isolated from the movable components of the switch, discussed hereinafter, by an insulation layer 123 which may be fixed to frame 103 although such is not explicitly shown. As with the pull-in insulation layer 115, the pull-back insulation layer 123 may be fabricated of any convenient insulating material, such as among other things silicon nitride, silicon oxide, etc. Moreover, in an embodiment of the invention, the insulation layer 123 may be omitted, as illustrated by the switch 801 shown in FIG. 8.

The switch 101 further comprises in an embodiment of the invention a movable switch element 117 and a bearing element 119. The bearing element 119 is fixed within the frame 103 to provide a guide for the switch element 117. In an embodiment of the invention to be discussed later, the frame 103 itself serves as the bearing or guide for the switch element. In overview, the switch element 117 is movable along its major axis such that at one end of its travel it bridges the first and second terminals 107, 109 and at the other end of its travel it contacts the pull-back insulation layer 123 that is situated between the element 117 and the pull-back contact 121.

Note that in an embodiment of the invention, only one of contacts 113 and 121 is used. In particular, a single contact may be used to apply both a repulsive and an attractive force for opening and closing the switch. Thus, for example, contact 113 may actuate the switch element 117 in both directions by applying voltages of opposite polarities, without the use of a contact such as contact 121.

Figure 2A:
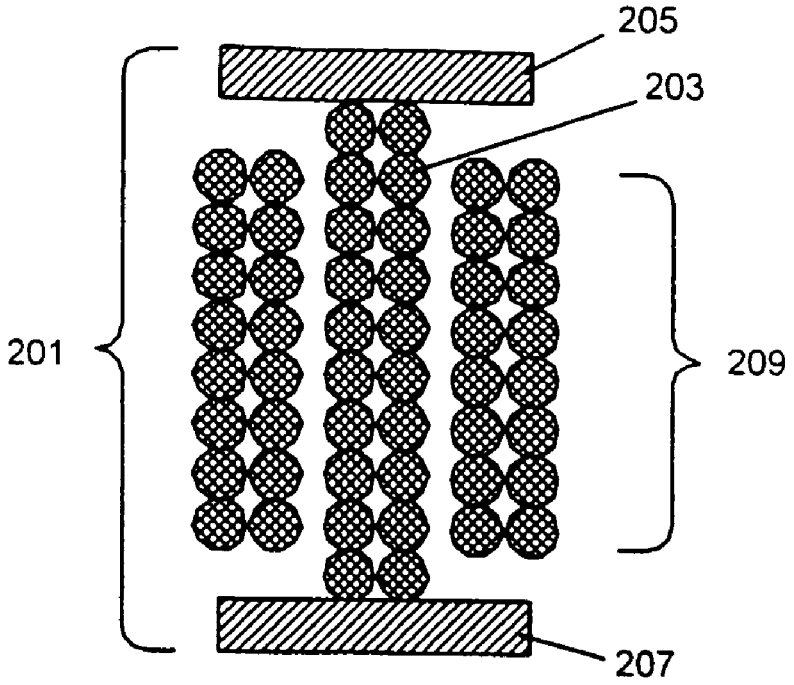
FIG. 2A is a cross-sectional side view of an exemplary switch rod and hollow bearing rod and the relationship there between for use in a microelectromechanical switch according to an embodiment of the invention.
Figure 2B:
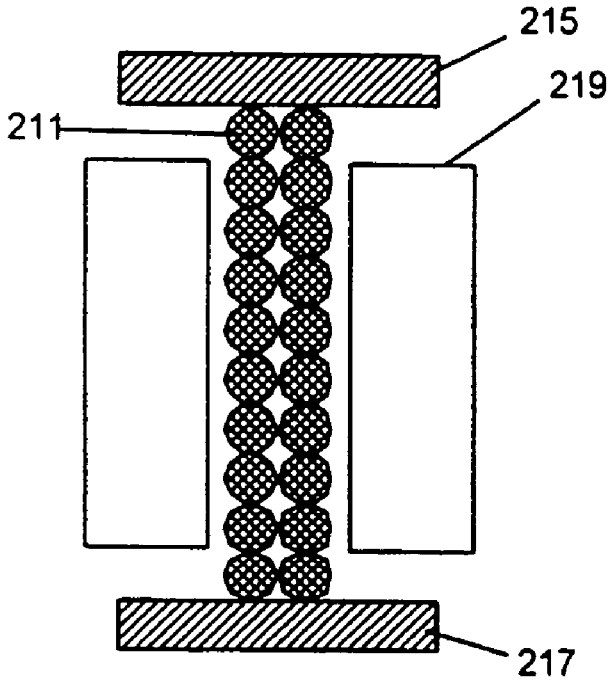
FIG. 2B is a cross-sectional side view of an alternative switch rod and hollow bearing rod and the relationship there between for use in a microelectromechanical switch according to an embodiment of the invention.
Figure 2C:
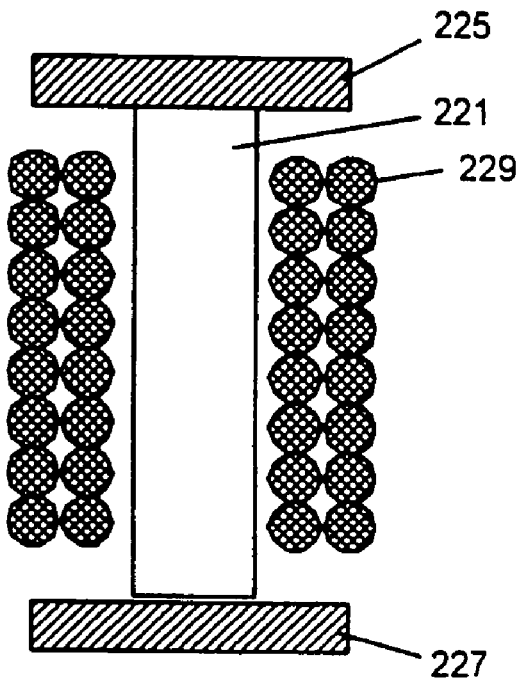
FIG. 2C is a cross-sectional side view of another alternative switch rod and hollow bearing rod and the relationship there between for use in a microelectromechanical switch according to an embodiment of the invention.

The operation of the switch will be detailed below, but first a brief discussion of several types of switch elements and bearings will be given. FIGS. 2A, 2B, and 2C show a non-exhaustive selection of switch elements and bearings, and will be discussed in order. FIG. 2A illustrates a switch element 201 comprised of a switch rod 203 and switch contacts 205 and 207 situated at the ends of the switch rod 203. The switch rod 203 is surrounded by a switch bearing 209. The switch bearing is preferably a tube or toroid, and is shown in lateral cross-section. In the embodiment of the invention shown in FIG. 2A, both the switch rod 203 and the switch bearing 209 are comprised of tubes of carbon atoms generally known as nanotubes or buckytubes (a derivation from the term Buckminster fullerenes which refers to a class of spherical molecules comprised of carbon atoms having alternating weak and strong atomic bonds similar in configuration to the geodesic structures pioneered by R. Buckminster Fuller).

Nanotubes may be fabricated in a controlled manner via any of a number of different processes. One technique usable for the controlled fabrication of nanotubes is the technique of photolithography. Another usable technique is the technique of chemical vapor deposition, such as for example CCVD. In CCVD, catalyst nano-particles can be positioned onto a substrate lithographically to initiate nanotube growth only at desired locations. Nanotubes can be fabricated in a variety of sizes and lengths. Typically the tubes are multi-walled, meaning that a number of concentric wrapped sheets form the tube structure, however single walled tubes are also possible.

With respect to an embodiment of the invention such as shown in FIG. 2A, the bearing 209 and switch rod 203 may be formed from a single multi-walled nanotube which has had the ends opened and the outer tube or tubes truncated. An exemplary technique for opening the tube ends and manipulating individual component tubes is discussed by J. Cummings and A. Zettl in "Low-Friction Nanoscale Linear Bearing Realized from Multiwall Carbon Nanotubes," Science, v289, pp. 602-604 (Jul. 28, 2000), which is herein incorporated by reference in its entirety for all of its teachings and references (also incorporated herein by reference in their entireties) without limitation or exclusion. Alternatively, the bearing and switch rod may be fabricated from separate nanotubes. An interesting property of nanotubes is that nanotubes can repeatedly telescope with respect to each other with very little frictional impedance or inter-tube attraction (van der Waals) and accumulate little, if any, wear or fatigue. Thus, a switch according to an embodiment of the invention incorporating nanotube bearing and switch rod exhibits long lifetime and low wear with repeated use. As well, the low frictional interaction allows for reduced switching power.

Shown in FIG. 2B, an alternative embodiment of the invention has a switch rod 211 fabricated from one or more nanotubes, as with the embodiment of the invention illustrated in FIG. 2A. However, the bearing 219 in the embodiment of FIG. 2B is comprised of an alternative material rather than nanotubes. Examples of such materials are materials that can be fabricated in sufficiently miniature form and that exhibit a low frictional interaction with the nanotube rod 211. For example, silicon and many other materials would be suitable in this regard. Molecular solids such as fullerene crystals may also be utilized depending upon the manufacturer's preference.

A switch rod and bearing assembly usable within yet another embodiment of the invention are illustrated in FIG. 2C. In the assembly shown in FIG. 2C, the bearing 229 comprises one or more nanotubes. However, the switch rod 221 is fabricated from an alternative material. Suitable materials include silicon, metals, and polymers, as well as any other material that is suitable of being fabricated in the appropriate miniature form. One benefit of this type of structure is that the low frictional properties of nanotubes are exploited while allowing the switch rod 221 to be formed of a material that may be more easily adhered to the end contacts 225, 227, which will be discussed in greater detail hereinafter.

The contacts at the ends of the switch rod are illustrated in FIGS. 2A-2C as elements 205 and 207, 215 and 217, and 225 and 227 respectively. The purpose of one of the contacts is to react to the pull-back contact to open the switch, while the purpose of the other contact is both to react to the pull-in contact to close the switch as well as to conductively bridge the first and second switch terminals. For this reason, both contacts preferably comprise at least a conductive layer, with an additional preference that the actual surface of the contact nearest the pull-in contact be conductive as well.

Any suitable material may be used, but preferred materials are metals and highly doped semiconductors. In an embodiment of the invention, the switch rod contacts 205, 207, 215, 217, 225, and 227 each comprise a metallic filament such as a copper nanowire positioned across the end of the rod. In an alternative embodiment of the invention, the contacts 205, 207, 215, 217, 225, and 227 each comprise a photolithographically defined metallic plate. Certainly the contacts do not need to be made of the same material for a given switch assembly, and in some circumstances it may be desirable to use a different material for one contact than for the other. It will be appreciated that the use of metallic contacts allows for good ohmic contact and minimal insertion loss for the switch assembly.

Figure 3:
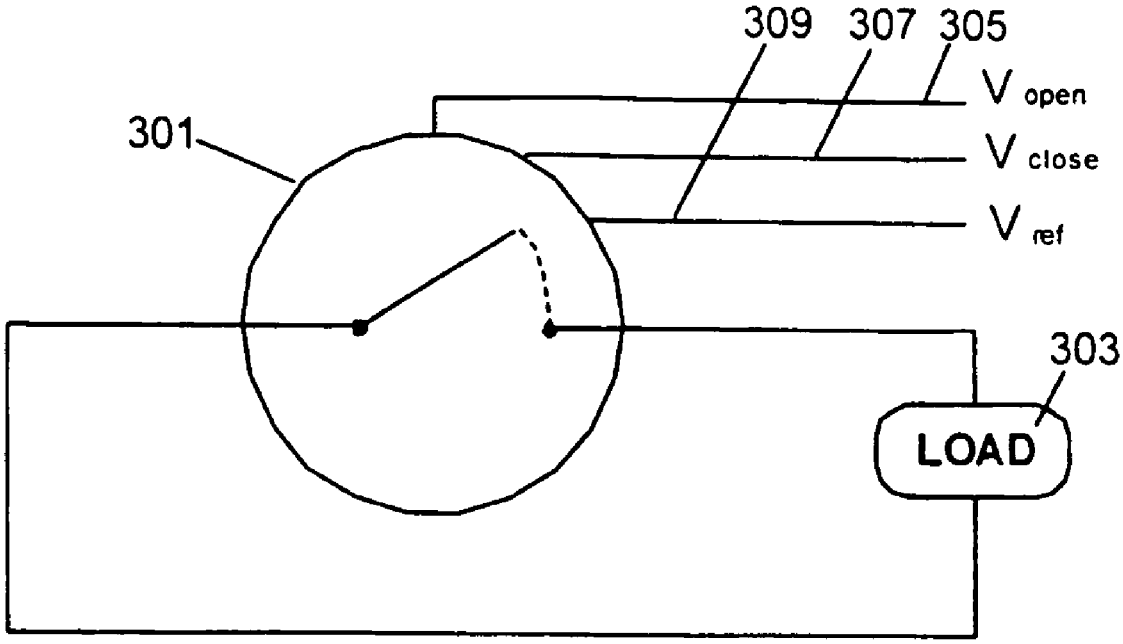
FIG. 3 is an electrical schematic diagram illustrating an equivalent circuit representation of a switch assembly according to an embodiment of the invention.

FIG. 3 is a schematic electronic circuit representation of a switch according to an embodiment of the invention as well as its operating environment. In particular, the switch is represented as a single pole single throw switch 301, switching across a load 303. The exact nature of the load 303 is not important, and the load 303 may be for example any circuit or element that can utilize or react to a switch. The switch 301 is opened by the application of an appropriate bias voltage to the $V_{open}$ lead 305. Likewise, the switch 301 is closed by the application of an appropriate bias voltage to the $V_{close}$ lead 307. Bias voltages may be established with reference to a reference voltage $V_{ref}$ as set at the $V_{ref}$ lead 309.

Figure 4A:
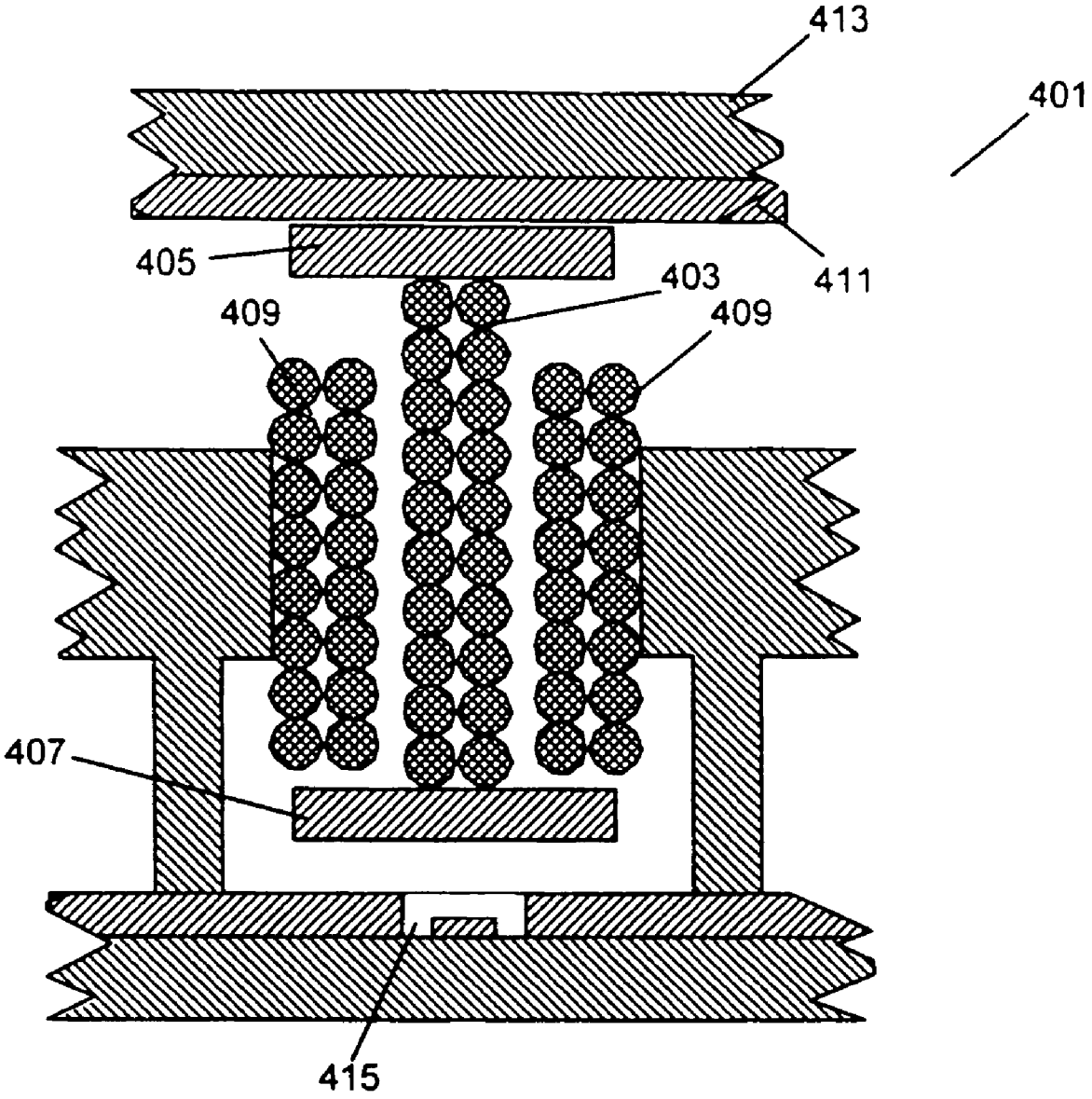
FIG. 4A is a cross-sectional side view of an exemplary microelectromechanical switch assembly according to an embodiment of the invention, wherein the switch rod has been deflected so that the switch assembly is in an open state.

Given this understanding of the circuit operation of the switch, the physical operation of the switch will be described in greater detail with reference to FIGS. 4A, 4B, and 5. FIG. 4A illustrates a switch assembly 401 according to an embodiment of the invention, wherein the switch assembly 401 is open. It can be seen that that the switch rod 403 and associated switch contacts 405, 407 (collectively referred to as the switch rod assembly) have moved upward relative to the bearing 409. As a result the top switch contact 405 is in contact with the insulation layer 411 protecting the pull-back contact 413. In an embodiment of the invention, the switch rod 403, along with its associated contacts 405, 407, was actuated to move to this position via the application of a bias voltage to the pull-back contact 413, and the resulting electrostatic attraction between the switch rod contact 405 and the pull-back contact 413. In an embodiment of the invention, the switch rod assembly including elements 403, 405, and 407, is biased, such as via a spring or other physical element or force to reside in the illustrated position when no switching bias is applied to the pull-in contact 415, regardless of whether a switching bias is applied to the pull-back contact 413. The alternative embodiments of the invention described below by reference to FIGS. 9A, 9B, 10A, and 10B illustrate this principle.

Figure 4B:
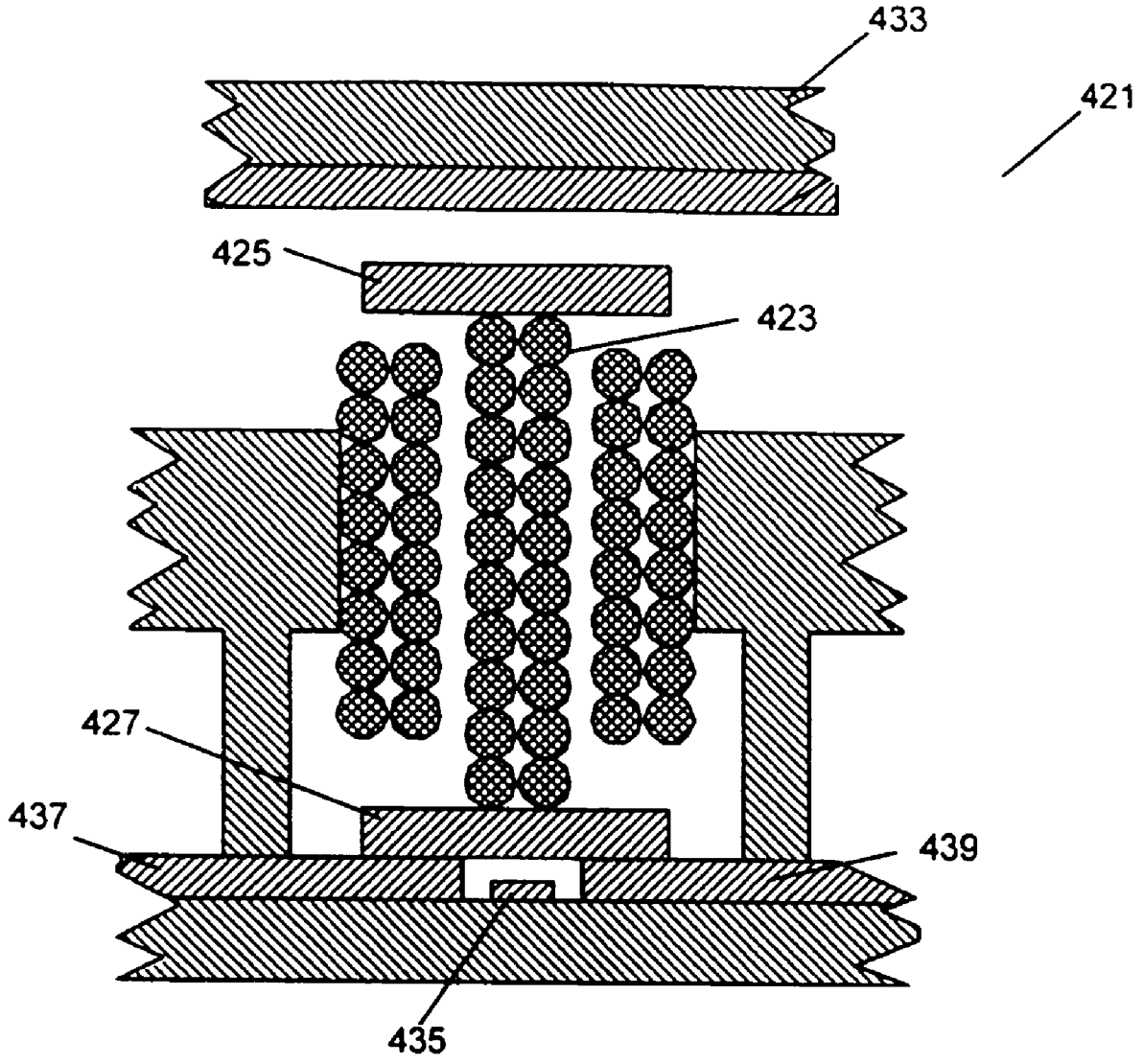
FIG. 4B is a cross-sectional side view of an exemplary microelectromechanical switch assembly according to an embodiment of the invention, wherein the switch rod has been deflected so that the switch assembly is in a closed state.

FIG. 4B illustrates the same assembly 421 as shown in FIG. 4A, however in FIG. 4B the switch assembly 421 is closed, i.e. the switch rod assembly 423, 425, 427 is now at the other end of its travel range. In this state, the bottom switch rod contact 427 contacts both switch terminals 437 and 439 completing a circuit there between. Note that in an embodiment of the invention, the switch rod assembly including elements 423, 425, and 427, is biased, such as via a spring or other physical element to reside in the illustrated position when no switching bias is applied to the pull-back contact 433, regardless of whether a switching bias is applied to the pull-in contact 435.

Figure 5:
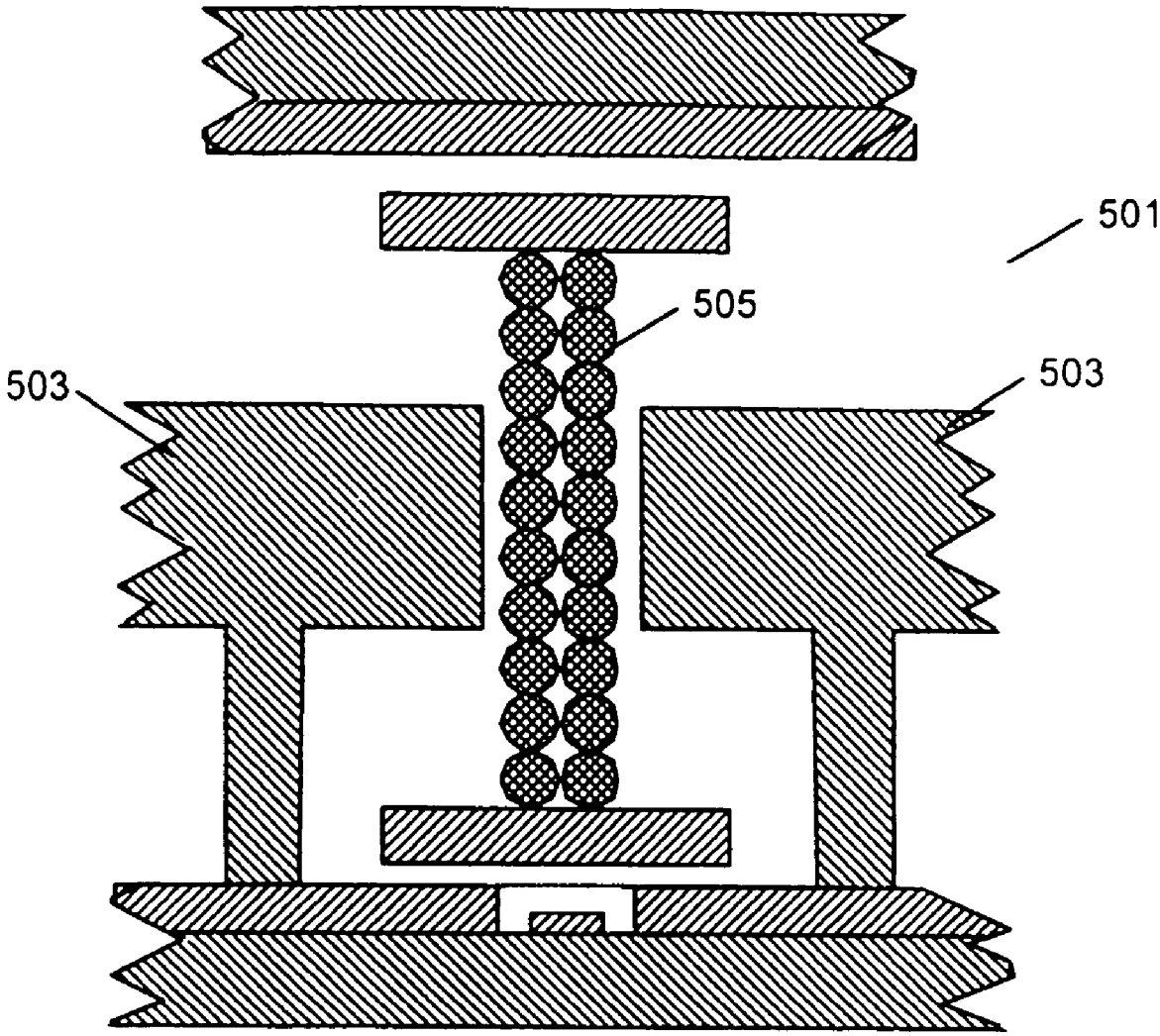
FIG. 5 is a cross-sectional side view of a microelectromechanical switch according to an embodiment of the invention having an alternative frame construction and bearing structure.

FIG. 5 illustrates an alternative bearing arrangement for a switch assembly 501 according to an embodiment of the invention. In particular, the switch assembly 501 comprises many of the elements shown with regard to the switch assembly 101 of FIG. 1, however, the embodiment shown in FIG. 5 employs an alternative bearing element. As can be seen, in this embodiment of the invention, the frame 503 is itself used as a bearing for the switch rod 505. While the frictional properties of nanotubes vary depending upon whether the mating surface is another nanotube or rather a different material, most mating materials, such as silicon or germanium, will allow the switch rod 505 to move with sufficiently low friction so as to allow electrostatic actuation of the assembly. There are some benefits obtainable via the alternative bearing arrangement shown, including, for some facilities, increased ease of fabrication, as well as other benefits.

Figure 6:
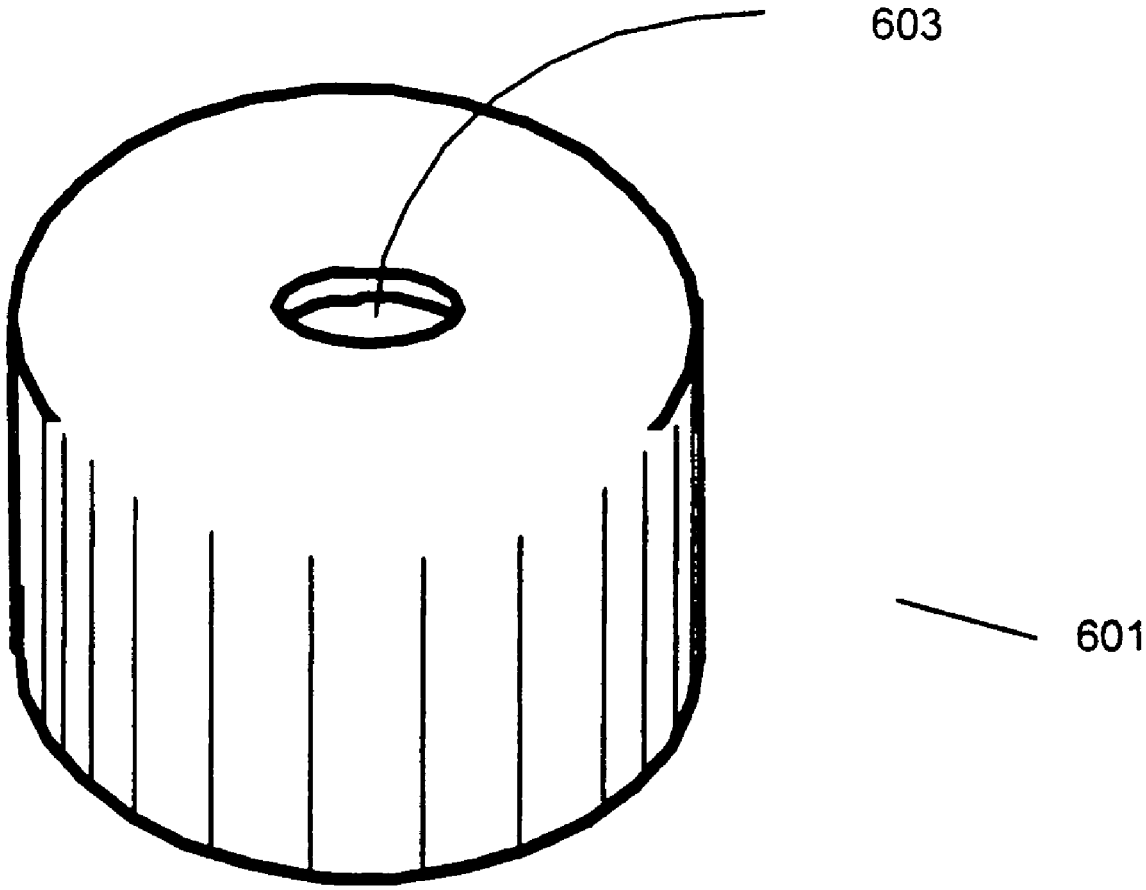
FIG. 6 is a perspective view from above an exemplary switch frame structure adapted primarily for a switch rod of substantially round or polygonal cross-section for use in a microelectromechanical switch according to an embodiment of the invention.
Figure 7:
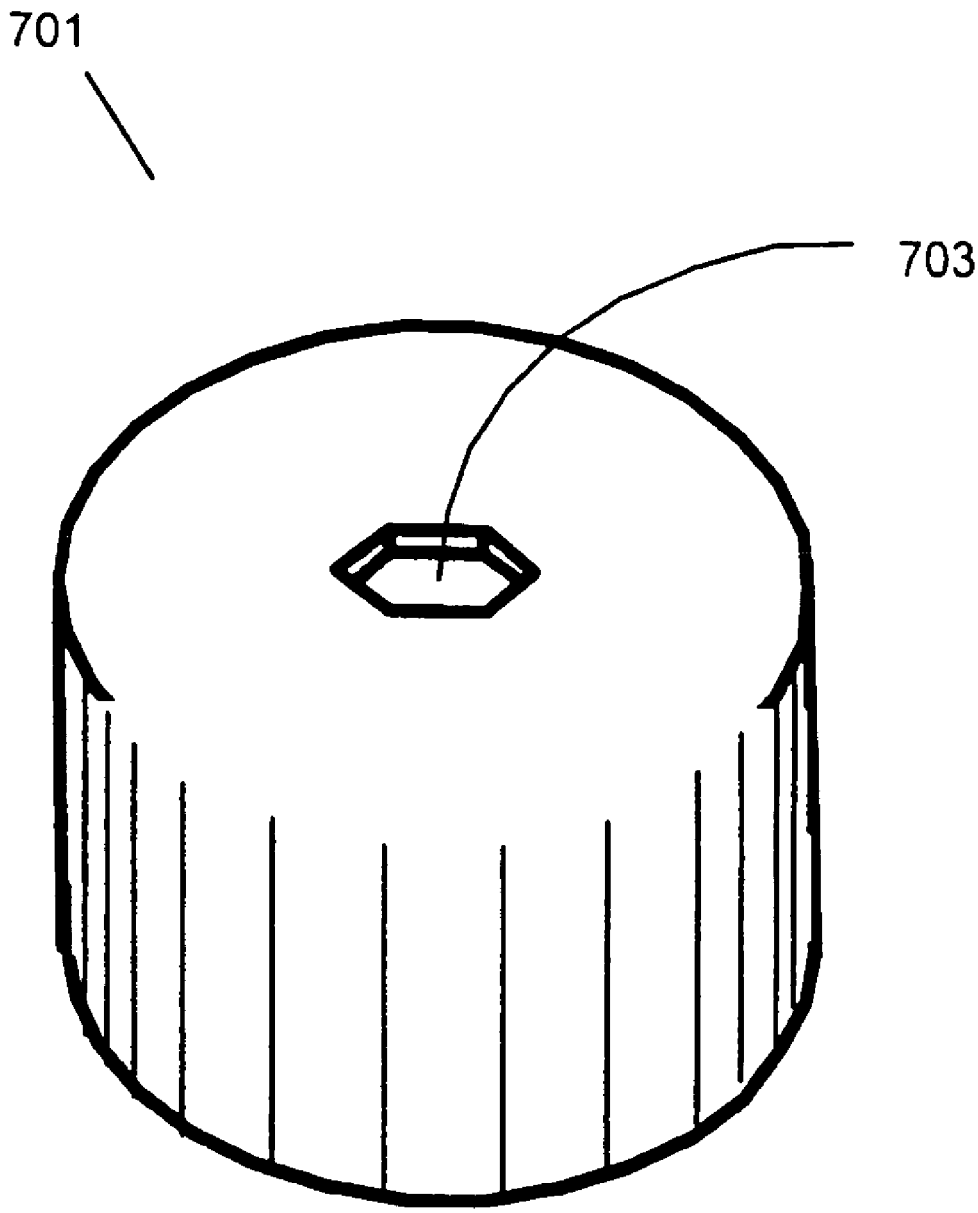
FIG. 7 is a perspective view from above an alternative exemplary switch frame structure adapted primarily for a switch rod of substantially round or polygonal cross-section for use in a microelectromechanical switch according to an embodiment of the invention.

With respect, for example, to the embodiment of the invention illustrated in FIG. 5, the frame portion 503 that is used as a bearing may have any shape. Supplementing the cross-sectional view of FIG. 5, FIGS. 6 and 7 illustrate in perspective view a sampling of possible shapes for the frame portion 503 acting as a bearing. In particular, the corresponding frame portion 601 of FIG. 6 is generally round and has a round opening 603 that acts as a bearing surface against a switch rod. In FIG. 7, the relevant frame portion 701 is still generally round but has a polygonal opening 703 to act as a bearing surface against the switch rod. It will appreciated that the frame bearing opening 603, 703 may be of any suitable other shape that will sufficiently confine the switch rod. In addition, the shape of the supporting frame portion 601, 701 may be of any shape as well depending upon design considerations such as other circuitry laid out in the vicinity of the switch, fabrication processes used, etc. It will be appreciated as well that the switch rod may be of any suitable cross-section including round, polygonal, symmetric, asymmetric, and so on.

Figure 9A:
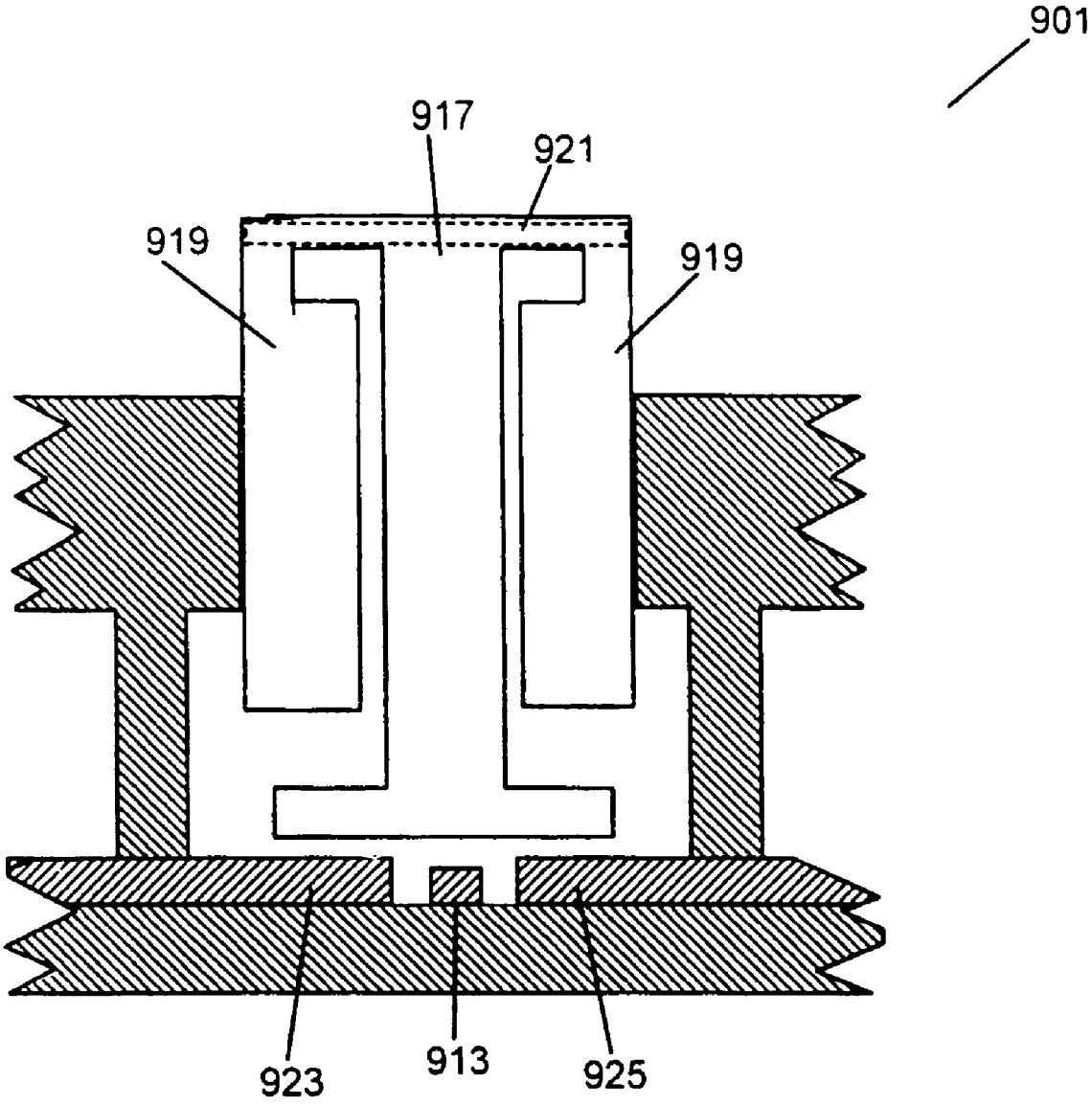
FIG. 9A is a cross-sectional side view of a microelectromechanical switch according to an alternative embodiment of the invention, wherein the switch is in an open position.
Figure 9B:
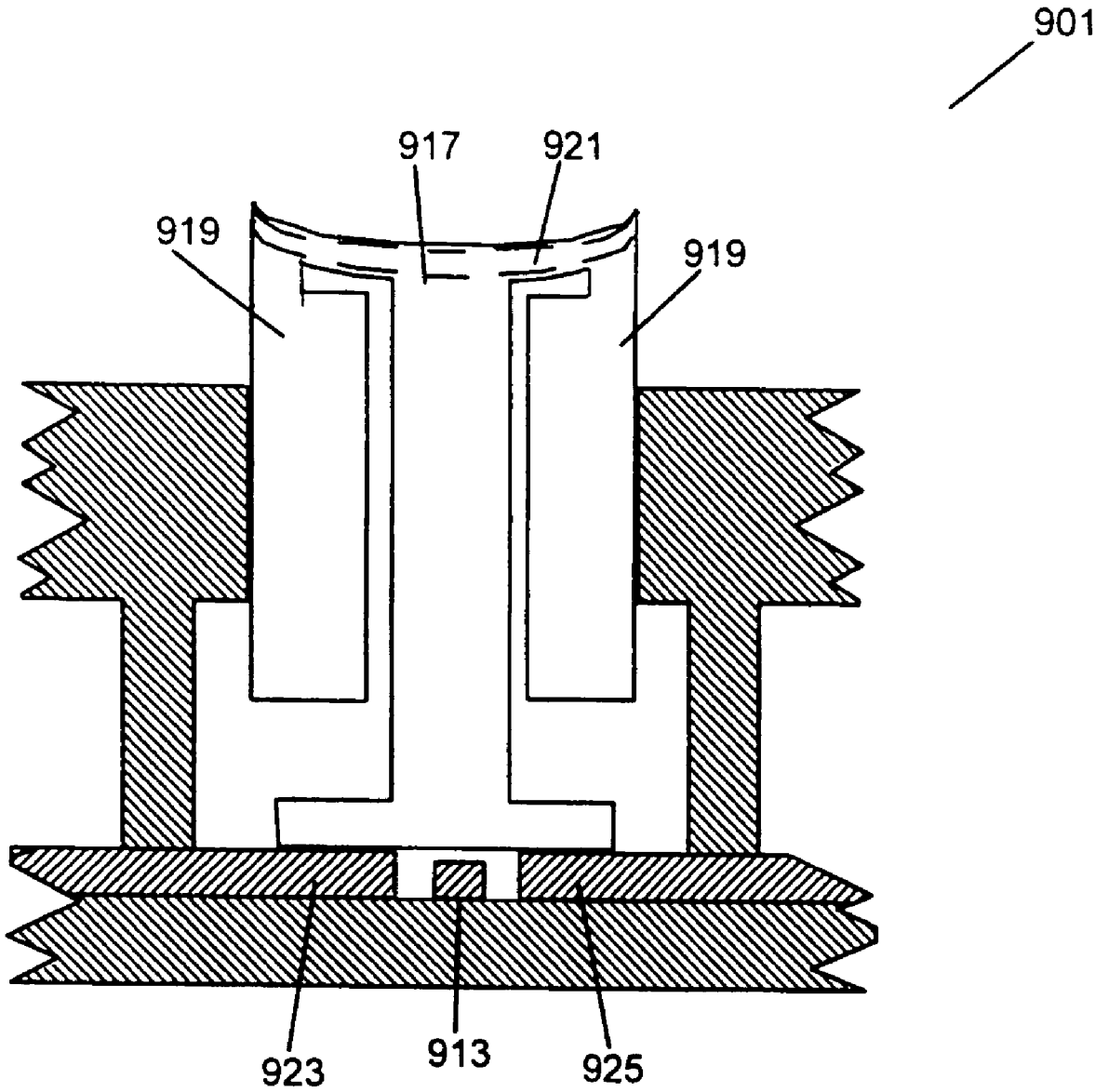
FIG. 9B is a cross-sectional side view of a microelectromechanical switch according to an alternative embodiment of the invention, wherein the switch is in a closed position.

In alternative exemplary embodiments of the invention, other mechanisms are employed for actuation of the switch element. By way of example and not limitation, two such embodiments of the invention are discussed hereinafter. Referring to FIGS. 9A and 9B, two configurations of a first alternative embodiment of the invention are shown. As shown in FIG. 9A, the switch 901 is similar to the switch shown in FIG. 8. However, the switch element 917 of the switch 901 is no longer entirely free floating vertically, but instead is connected to the frame elements 919 via a thin membrane region 921 (highlighted by dashed outline). In its unbiased state, the membrane 921 holds the element 917 out of contact with the terminals 923, 925.

FIG. 9B illustrates the switch 901 of FIG. 9A in an "on" state. In particular, a deflection voltage is applied to the pull-in contact 913, which electrostatically attracts the element 917 against the elastic force of the membrane 921, thus elastically deforming the membrane 921 for the duration of the applied voltage. In this manner, a single magnitude and polarity of applied voltage may be used to actuate the switch without the need for an additional pull-back contact.

Figure 10A:
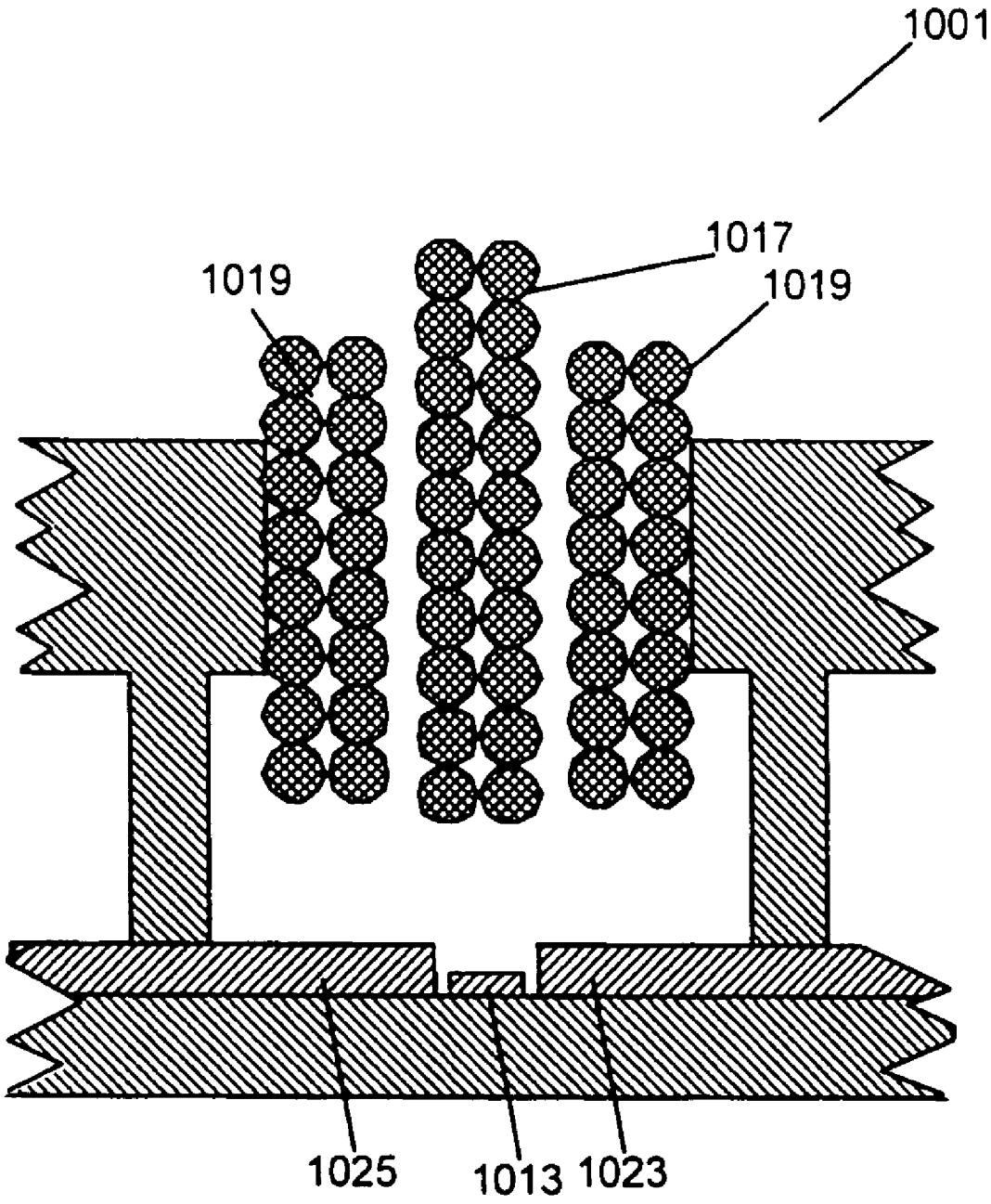
FIG. 10A is a cross-sectional side view of a microelectromechanical switch according to another alternative embodiment of the invention, wherein the switch is in an open position.
Figure 10B:
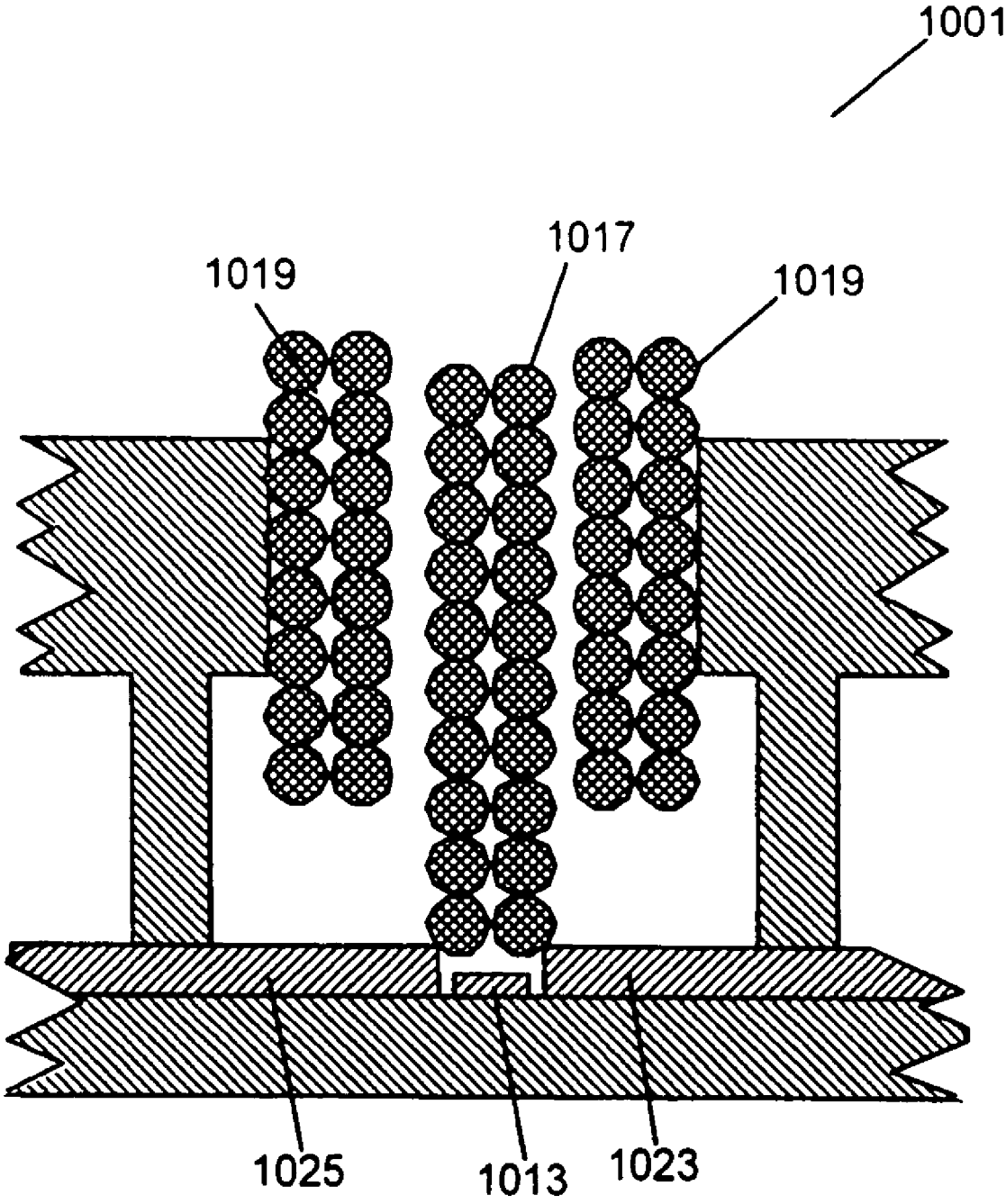
FIG. 10B is a cross-sectional side view of a microelectromechanical switch according to another alternative embodiment of the invention, wherein the switch is in a closed position.

A further alternative embodiment of the invention is illustrated in FIGS. 10A and 10B. Referring to FIG. 10A, a switch 1001 is illustrated having a nanotube switch element 1017 within a nanotube bearing element 1019. Thus, elements 1017, 1019 are cylindrical and concentric. Each nanotube 1017, 1019 may in turn be comprised of one or more individual nanotubes (layers or shells). In addition, the nanotubes 1017, 1019 may originate as different layers within a single multiwall nanotube. It has been found that when nested nanotubes are telescopically changed from their equilibrium relationship, an elastic restorative force is exerted back toward the equilibrium position. This force is thought to be the result of intertube van der Waals attraction. See, for example, J. Cumings and A. Zettl, "Low-Friction Nanoscale Linear Bearing Realized From Multiwall Carbon Nanotubes," referenced and incorporated above.

The embodiment shown in FIG. 10A exploits this property of nested carbon nanotubes. In particular, the concentric nanotube elements 1017, 1019 are shown in their equilibrium position, in which position the contacts 1023 and 1025 are not bridged. Application of an appropriate bias voltage to contact 1013 results in the configuration shown in FIG. 10B. In particular, the switch element 1017 is electrostatically deflected from its equilibrium relationship with bearing nanotube 1009 for as long as the bias voltage is applied, after which the nanotube (switch element) 1017 will spring back to its equilibrium position and the switch 1001 will again be open. While the switch element 1017 is deflected, its end bridges the contacts 1023, 1025, closing the switch. Note that the element 1017 may comprise an end plate for bridging the contacts 1023, 1025, which has been affixed to the element 1017 by suitable means such as spot welding.

It will be appreciated that an improved microelectromechanical switch assembly and elements have been described herein. In view of the many possible embodiments to which the principles of this invention may be applied, it should be recognized that the embodiments described herein with respect to the drawing FIGS. are meant to be illustrative only and should not be taken as limiting the scope of invention.

Therefore, the invention as described herein contemplates all such embodiments as may come within the scope of the following claims and equivalents thereof.

We claim:

1. A micro-mechanical switch comprising: mutually non-contacting first and second switch terminals; a switch rod having a primary axis and comprising first and second switch plates at respective first and second ends of the switch rod, the switch rod having a range of travel along its primary axis bounded by respective first and second limit positions; a hollow bearing having a primary axis that is substantially collinear with the primary axis of the switch rod, wherein the hollow bearing surrounds the switch rod and constrains the switch rod such that the primary axis of the switch rod remains substantially collinear with the primary axis of the hollow bearing; and first and second relay plates associated with the respective first and second switch plates operable to move the switch rod along its primary axis, whereby when the switch rod is in the first limit position, the first switch plate conductively bridges the first switch terminal to the second switch terminal, and when the switch rod is in the second limit position, the first switch plate does not conductively bridge the first switch terminal to the second switch terminal, and wherein the switch rod and the hollow bearing each comprise at least one carbon nanotube, and wherein the switch rod and the first and second switch plates at the ends of the switch rod are electrically unbiased and are moved via an external deflection field alone.

2. The micro-mechanical switch according to claim 1, wherein the first and second relay plates are each adapted to apply an electrostatic deflection field to cause the switch rod to move between the first and second limit positions.

3. The micro-mechanical switch according to claim 1, wherein the switch rod and the hollow bearing are fabricated from a single multi-walled nanotube.

4. The micro-mechanical switch according to claim 1, wherein the switch rod and the hollow bearing are each fabricated from multi-walled nanotubes.

5. The micro-mechanical switch according to claim 1, further comprising an insulator element interposed between the second relay plate and the second switch plate, whereby when the switch rod is in the second limit position, the second switch plate is in contact with the insulator element and is not in conductive contact with the second relay plate.

6. The micro-mechanical switch according to claim 1, further comprising a frame element holding each of the first and second switch terminals, the first and second relay plates, and the hollow bearing in a fixed spatial relationship with respect to the remaining ones of the first and second switch terminals, the first and second relay plates, and the hollow bearing.

7. The micro-mechanical switch according to claim 6, wherein the frame element comprises an insulator portion interposed between the hollow bearing and the first relay plate.

8. The micro-mechanical switch according to claim 6, wherein the hollow bearing is integral with the frame element.

9. The micro-mechanical switch according to claim 1, wherein at least one of the first and second switch plates is of a type selected from the group consisting of a metallic filament and a metallic plate.

10. A micro-mechanical switch comprising: mutually non-contacting first and second switch terminals; a carbon nanotube switch rod having a primary axis and a range of travel along its primary axis; a hollow carbon nanotube bearing having a primary axis that is substantially collinear with the primary axis of the switch rod, wherein the hollow bearing surrounds the switch rod and constrains the switch rod such that the primary axis of the switch rod remains substantially collinear with the primary axis of the hollow bearing; and a pull-in plate between the first and second switch terminals operable to move the switch rod along its primary axis in a first direction, wherein the switch rod remains electrically unbiased during such movement, whereby the first switch terminal and the second switch terminal are conductively bridged.

11. The micro-mechanical switch according to claim 10, wherein the switch rod is adapted to conductively bridge the first switch terminal to the second switch terminal.

12. The micro-mechanical switch according to claim 10, wherein the switch rod comprises a conductive endplate for conductively bridging the first switch terminal to the second switch terminal.

13. The micro-mechanical switch according to claim 10, wherein the pull-in plate is adapted to impose an electrostatic deflection field to cause the switch rod to move along its primary axis in the first direction.

14. The micro-mechanical switch according to claim 13, wherein when an electrostatic deflection field is not imposed by the pull-in plate, the switch rod and the hollow bearing are held in an equilibrium position by electrostatic interaction between the switch rod and the hollow bearing.

15. The micro-mechanical switch according to claim 14, wherein the switch rod and the hollow bearing are fabricated from a single multi-walled nanotube.

16. The micro-mechanical switch according to claim 14, wherein the switch rod and the hollow bearing are each fabricated from a separate nanotube selected from the group consisting of single-walled nanotubes and multi-walled nanotubes.

* * * * *